US009300056B2

(12) United States Patent
Lee et al.

(10) Patent No.: US 9,300,056 B2
(45) Date of Patent: Mar. 29, 2016

(54) ARRAY ANTENNA OPTIMIZED FOR A BASE STATION COMMUNICATION SYSTEM

(71) Applicant: ACE TECHNOLOGIES CORPORATION, Incheon (KR)

(72) Inventors: Seung-Cheol Lee, Incheon (KR); Seung-Chul Lee, Busan (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 104 days.

(21) Appl. No.: 14/175,695

(22) Filed: Feb. 7, 2014

(65) Prior Publication Data

US 2014/0225792 A1 Aug. 14, 2014

(30) Foreign Application Priority Data

Feb. 8, 2013 (KR) ..... 10-2013-0014529

(51) Int. Cl.

| | |
|---|---|
| ***H01Q 1/00*** | (2006.01) |
| ***H01Q 21/30*** | (2006.01) |
| *H01Q 13/10* | (2006.01) |
| *H01Q 3/26* | (2006.01) |
| *H01Q 3/44* | (2006.01) |
| *H01Q 21/06* | (2006.01) |
| *H01Q 5/00* | (2015.01) |
| *H01Q 1/24* | (2006.01) |
| *H01Q 21/08* | (2006.01) |
| *H01Q 5/307* | (2015.01) |

(52) U.S. Cl.

CPC ..... *H01Q 21/30* (2013.01); *H01Q 1/246* (2013.01); *H01Q 3/26* (2013.01); *H01Q 3/44* (2013.01); *H01Q 5/0006* (2013.01); *H01Q 5/307* (2015.01); *H01Q 13/10* (2013.01); *H01Q 21/061* (2013.01); *H01Q 21/064* (2013.01); *H01Q 21/08* (2013.01)

(58) Field of Classification Search

CPC ..... H01Q 3/44; H01Q 5/0006; H01Q 13/10; H01Q 21/064; H01Q 3/26; H01Q 21/061

USPC ..... 343/700, 893, 729, 853, 776, 770

See application file for complete search history.

(56) References Cited

U.S. PATENT DOCUMENTS

| | | | | |
|---|---|---|---|---|
| 5,248,983 A * | 9/1993 | Kleiber et al. | ..... | 342/408 |
| 2009/0027299 A1 * | 1/2009 | Peng et al. | ..... | 343/893 |

* cited by examiner

*Primary Examiner* — Joseph Lauture

(74) *Attorney, Agent, or Firm* — TechLaw LLP

(57) ABSTRACT

Disclosed is an antenna in which certain radiators are shared for multiple frequency bands. The antenna may include at least one first radiator for a first frequency band; one or more second radiator for a second frequency band; and a third radiator. Here, the third radiator may be used when realizing the first frequency band and may also be used when realizing the second frequency band.

13 Claims, 7 Drawing Sheets

ARRAY ANTENNA OPTIMIZED FOR A BASE STATION COMMUNICATION SYSTEM

CROSS-REFERENCE TO RELATED APPLICATIONS

This application claims the benefit of Korean Patent Application No. 10-2013-0014529, filed with the Korean Intellectual Property Office on Feb. 8, 2013, the disclosure of which is incorporated herein by reference in its entirety.

BACKGROUND

1. Technical Field

The present invention relates to an array antenna optimized for a base station communication system.

2. Description of the Related Art

An array antenna used in a base station generally includes radiators for each frequency band, for example as seen in Korean Patent Publication No. 2005-0088753. Thus, realizing multiple frequency bands would result in increases in both the size and weight of the antenna.

SUMMARY

An aspect of the invention is to provide an antenna in which certain radiators are shared for multiple frequency bands.

To achieve the objective above, an embodiment of the invention provides an antenna that includes: at least one first radiator for a first frequency band; one or more second radiator for a second frequency band; and a third radiator, where the third radiator is used when realizing the first frequency band and is also used when realizing the second frequency band.

Another embodiment of the invention provides an antenna that includes: at least one first radiator; and one or more second radiator. Here, the first radiator and the second radiator are used for a first frequency band, and only the second radiator from among the radiators are used when realizing a second frequency band.

Still another embodiment of the invention provides an antenna that includes radiators. Here, some of the radiators are operated when realizing a first frequency band, some of the radiators are operated when realizing a second frequency band, and at least one of the radiators are used both when realizing the first frequency band and when realizing the second frequency band.

Yet another embodiment of the invention provides an antenna that includes: at least one radiator used commonly for a multiple number of frequency bands; and a phase shifter configured to supply power to the radiator.

An antenna based on an embodiment of the invention can share certain radiators for multiple frequency bands, thus making it possible to reduce the size and weight of the antenna as well as to lower the cost for manufacturing the antenna.

Additional aspects and advantages of the present invention will be set forth in part in the description which follows, and in part will be obvious from the description, or may be learned by practice of the invention.

DETAILED DESCRIPTION

Certain embodiments of the present invention are described below in more detail with reference to the accompanying drawings.

The present invention relates to an antenna, such as an array antenna for a base station, for example, and proposes a method of sharing some of the radiators for multiple frequency bands. This can reduce the size and weight of the antenna and can lower manufacturing costs.

Various possible structures for the antenna are described below in more detail with reference to the accompanying drawings.

Figure 1:
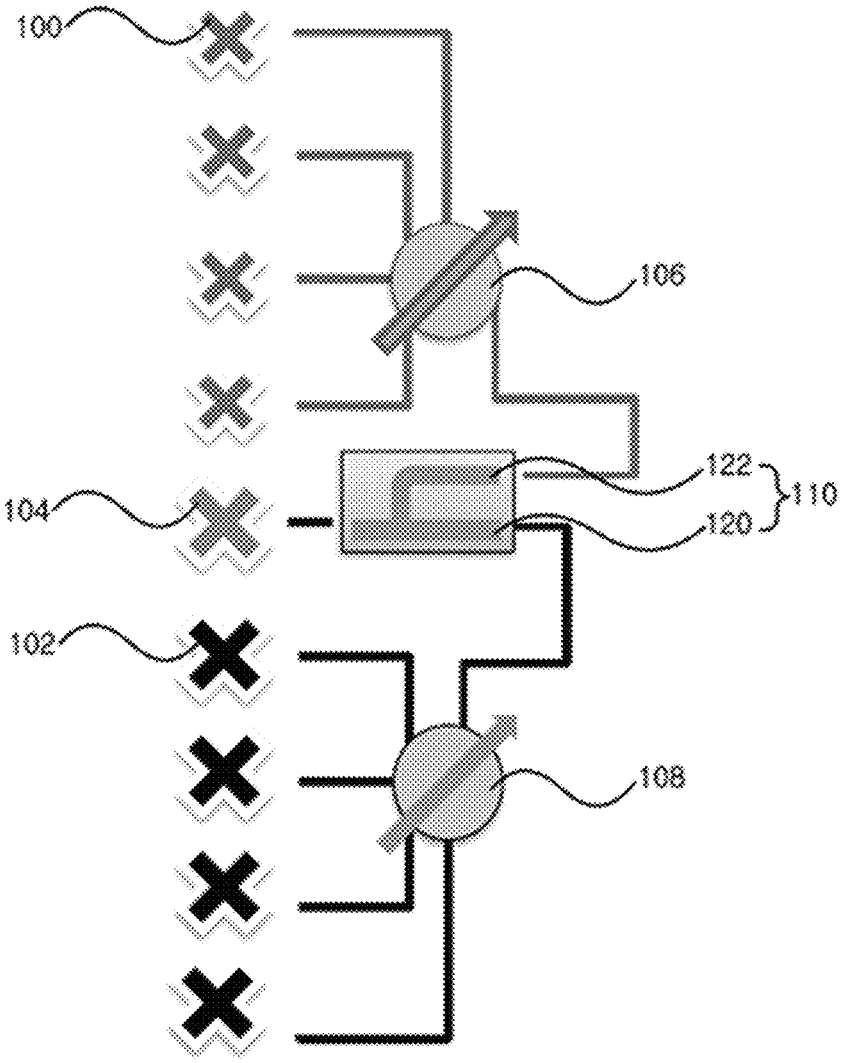
FIG. 1 schematically illustrates an antenna according to a first disclosed embodiment of the invention.

FIG. 1 schematically illustrates an antenna according to a first disclosed embodiment of the invention.

Referring to FIG. 1, an antenna based on this embodiment can include at least one first radiator 100, one or more second radiator 102, a third radiator 104, a first phase shifter 106, a second phase shifter 108, and a diplexer 110.

Although it is not illustrated, the radiators 100, 102, and 104, phase shifters 106 and 108, and diplexer 110 can be arranged over a reflector plate (not shown) that is a conductor. The radiators 100, 102, and 104, phase shifters 106 and 108, and diplexer 110 can be arranged over the same side or over different sides of the reflector plate. For example, the reflectors 100, 102, and 104 and the diplexer 110 can be arranged over an upper surface of the reflector plate, while the phase shifters 106 and 108 can be arranged at the reverse side of the reflector plate. The connections between the radiators 100, 102, and 104 and the phase shifters 106 and 108, the connections between the phase shifters 106 and 108 and the diplexer 110, and the connection between the third radiator 104 and the diplexer 110 in FIG. 1 can be realized by cables or conductive patterns. The connections are not limited to particular types, as long as the components are electrically connected.

The phase shifters 106 and 108 may serve to deliver the inputted power to the respective radiators 100, 102, or 104, and to vary the phase of the power (RF signals) delivered respectively to the radiators 100, 102 or 104. These phase shifters 106 and 108 are not limited to a particular type. However, in the sense that power is being supplied, it can also be said that power supply elements, rather than phase shifters, are electrically connected to the radiators.

The diplexer 110 refers to an element that delivers two RF signals to the third radiator 104 without having the two RF signals affect each other.

The first radiators 100 can be elements for a first frequency band, while the second radiators 102 can be elements for a second frequency band.

The third radiator 104 can be used for both the first frequency band and the second frequency band, and for example can be arranged between the first radiators 100 and the second radiators 102.

For example, when the antenna outputs a radiation pattern for a high frequency band, the first radiators 100 and the third radiator 104 can be used. Conversely, when the antenna outputs a radiation pattern for a low frequency band, the second radiators 102 and the third radiator 104 can be used.

That is, the third radiator 104 can be used commonly for realizing a first frequency band and a second frequency band.

First, the overall structure of the antenna is described below.

The first phase shifter 106 may be electrically connected with the first radiators 100 and the third radiator 104. However, the first phase shifter 106 may be electrically connected to the third radiator 104 through the diplexer 110. According to an embodiment of the invention, the first radiators 100 and the third radiator 104 can be arranged over the reflector plate in certain intervals, and the phases of the electrical power provided to the first radiators 100 and third radiator 104 can be subject to certain conditions. For example, the phases of the power provided to the first radiators 100 and third radiator 104 can be incremented sequentially by θ.

The second phase shifter 108 may be electrically connected with the second radiators 102 and the third radiator 104. However, the second phase shifter 108 may be electrically connected to the third radiator 104 through the diplexer 110. According to an embodiment of the invention, the second radiators 102 and the third radiator 104 can be arranged over the reflector plate in certain intervals, and the phases of the electrical power provided to the second radiators 102 and third radiator 104 can be subject to certain conditions. For example, the phases of the power provided to the first radiators 100 and third radiator 104 can be incremented sequentially by θ.

A description will now be provided below of the procedures for outputting radiation patterns with such structure.

When outputting a radiation pattern for a first frequency band, e.g. 2.6 GHz, a power source (not shown) can supply power to each of the first radiators 100 through the first phase shifter 106, and can supply power to the third radiator 104 through the first phase shifter 106 and a second conductive line 122 of the diplexer 110. Here, the power source may not supply power to the second phase shifter 108. As a result, the antenna can output a radiation pattern for the first frequency band.

When outputting a radiation pattern for a second frequency band, e.g. 1.8 GHz, the power source can supply power to each of the second radiators 102 through the second phase shifter 108, and can supply power to the third radiator 104 through the second phase shifter 108 and a first conductive line 120 of the diplexer 110. Here, the power source may not supply power to the first phase shifter 106. As a result, the antenna can output a radiation pattern for the second frequency band.

In summary, an antenna based on this embodiment can include a radiator 104 that can be used commonly for multiple frequency bands.

A conventional antenna may include separate radiators for a first frequency band and separate radiators for a second frequency band. Thus, the number of radiators would have to be increased in proportion to the frequency bands of which realization is desired.

However, an antenna based on an embodiment of the invention may include at least one radiator 104 that can be used commonly in multiple frequency bands. Consequently, the number of radiators used in an antenna according to an embodiment of the invention can be smaller than the number of radiators used in a conventional antenna. Therefore, an antenna according to an embodiment of the invention can be provided in a reduced size and a reduced weight, and also with reduced manufacturing costs.

Although it was not mentioned above, the third radiator 104 can have the same structure as that of a first radiator 100 or the same structure as that of a second radiator 102. In FIG. 1, the third radiator 104 has the same structure as that of a second radiator 102. Of course, the third radiator 104 can have a different structure from those of the first radiator 100 and second radiator 102. The structure of the third radiator 104 can be designed adaptively according to the frequency band desired for realization.

Figure 2:
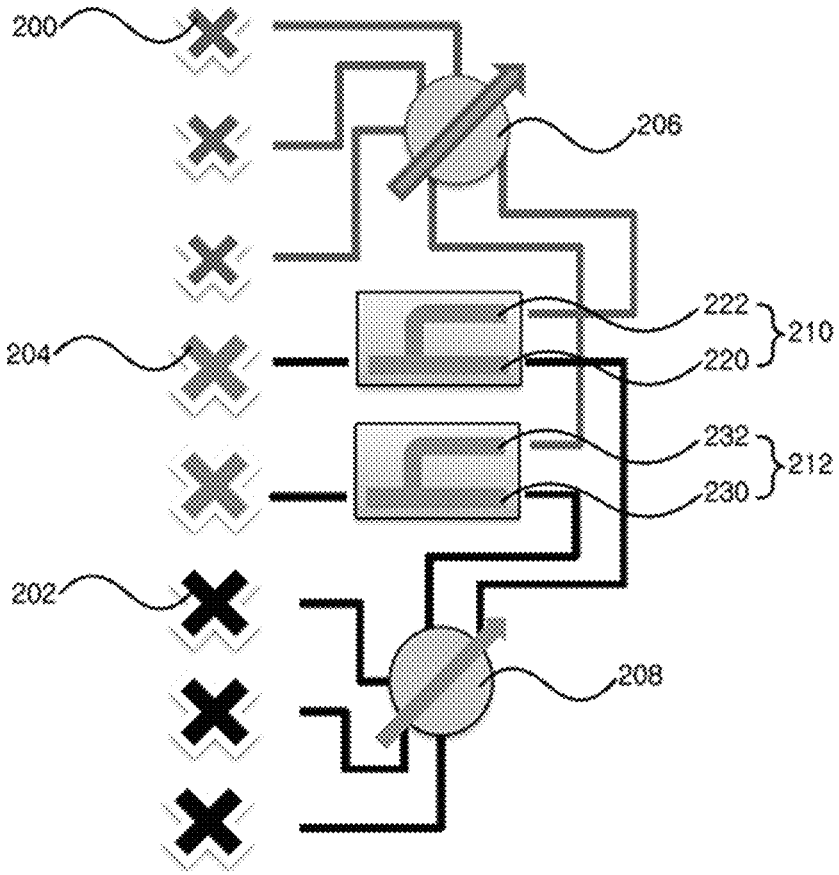
FIG. 2 schematically illustrates an antenna according to a second disclosed embodiment of the invention.

FIG. 2 schematically illustrates an antenna according to a second disclosed embodiment of the invention.

Referring to FIG. 2, an antenna based on this embodiment can include at least one first radiator 200, one or more second radiator 202, third radiators 204, a first phase shifter 206, a second phase shifter 208, a first diplexer 210, and a second diplexer 212.

Unlike the first disclosed embodiment, in which just one radiator 104 was used commonly for frequency bands, this embodiment can use a multiple number of third radiators 204 commonly for frequency bands.

A diplexer 210 or 212 may be arranged between each of the third radiators 204 and the corresponding phase shifters 206 or 208. That is, the third radiator 204 may be electrically connected with the phase shifters 206 or 208 by way of a diplexer 210 or 212.

When the antenna outputs a radiation pattern for a first frequency band, e.g. 2.6 GHz, the first phase shifter 206 can supply power to each of the first radiators 200, supply power to a corresponding third radiator 204 by way of a second conductive line 222 of the first diplexer 210, and supply power to a corresponding third radiator 204 by way of a fourth conductive line 232 of the second diplexer 212.

When the antenna outputs a radiation pattern for a second frequency band, e.g. 1.8 GHz, the second phase shifter 208 can supply power to each of the second radiators 202, supply power to a corresponding third radiator 204 by way of a first conductive line 220 of the first diplexer 210, and supply power to a corresponding third radiator 204 by way of a third conductive line 230 of the second diplexer 212.

That is, multiple third radiators 204 can be used commonly for multiple frequency bands. Here, the third radiators 204 can have the same structure as that of a first radiator 200 or a second radiator 202. Alternatively, one of the third radiators 204 can have the same structure as that of a first radiator 200, while another third radiator 204 can have the same structure as that of a second radiator 202.

As described with reference to FIG. 1 and FIG. 2, the antenna can include at least one third radiator that can be used commonly for multiple frequency bands. Here, the third radiator can be arranged in series with the first radiators and the second radiators.

Figure 3:
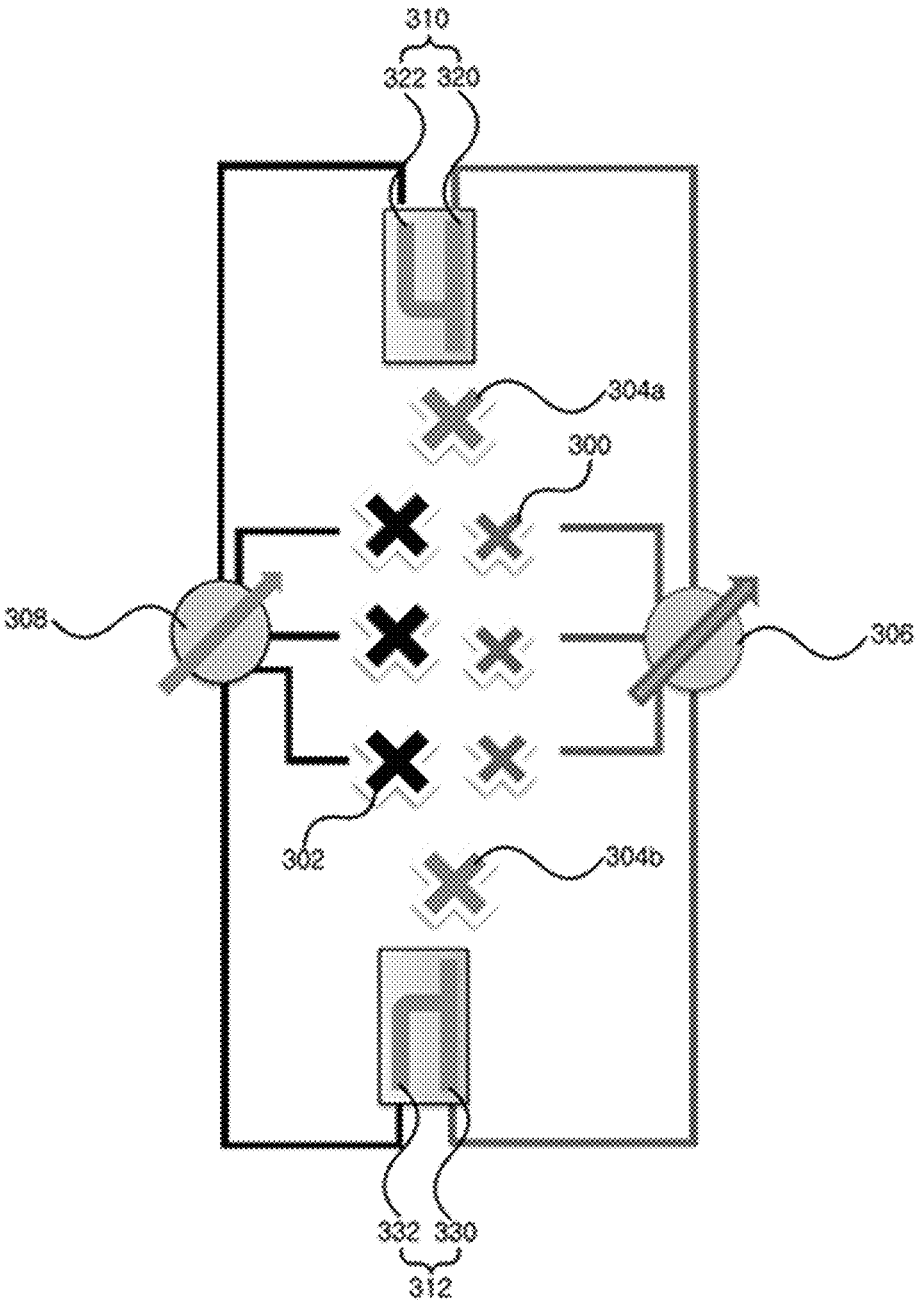
FIG. 3 schematically illustrates an antenna according to a third disclosed embodiment of the invention.

FIG. 3 schematically illustrates an antenna according to a third disclosed embodiment of the invention.

Referring to FIG. 3, an antenna based on this embodiment can include at least one first radiator 300, one or more second radiator 302, third radiators **304*a* and 304*b*, a first phase shifter 306, a second phase shifter 308, a first diplexer 310, and a second diplexer 312**.

Unlike the first disclosed embodiment and the second disclosed embodiment, in which the radiators were arranged in series, an antenna based on this embodiment can have the first radiators 300 and the second radiators 302 arranged in parallel, with the third radiators **304*a* and 304*b* arranged staggered with respect to the first radiators 300 and second radiators 302**.

The method of supplying power to the radiators 300, 302, and 304 is similar to that of the second disclosed embodiment and thus is not described here in further detail.

According to an embodiment of the invention, the third radiators 304*a* and 304*b* can have the same structure as that of a second radiator 302 for a low frequency band.

While the above refers to two third radiators 304*a* and 304*b*, it is also possible to have just one third radiator. In this case, the four first radiators can be arranged sequentially, the four second radiators can be arranged sequentially with respect to one another and in parallel with the first radiators, and the one third radiator can be arranged staggered with respect to the first radiators and second radiators.

While the above refers to the third radiators 304*a* and 304*b* being arranged in a staggered manner with respect to the first radiators 300 and second radiators 302, it can also be arranged in series with the first radiators 300 or the second radiators 302.

Figure 4:
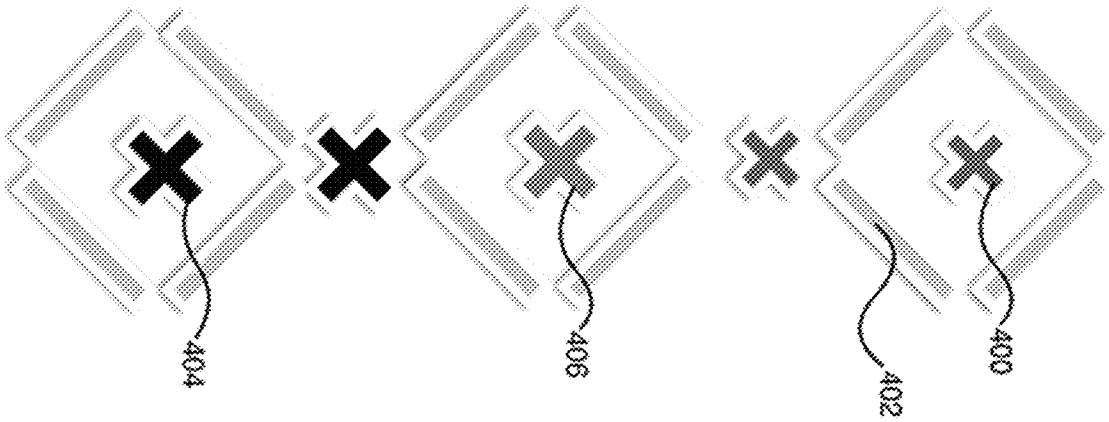
FIG. 4 schematically illustrates an antenna according to a fourth disclosed embodiment of the invention, for example a multi-band polarized antenna.

FIG. 4 schematically illustrates an antenna according to a fourth disclosed embodiment of the invention, for example a multi-band polarized antenna.

Referring to FIG. 4, the antenna may be a dual-band dual-polarized (DBDP) antenna, from among the types of multi-band polarized antennas, and can include radiators 400, 404, and 406 for a high frequency band and fourth radiators 402 for a low frequency band.

The radiators 400, 404, and 406 can be arranged inside the fourth radiators 402 or in-between the fourth radiators 402.

From among the radiators 400, 404, and 406 for a high frequency band, the first radiators 400 and the third radiator 406 can be used when realizing a 2.6 GHz band, for example, while the second radiators 404 and the third radiator 406 can be used when realizing a 1.8 GHz band, for example. In other words, the third radiator 406 can be shared for multiple frequency bands. Here, the third radiator 406 can have the same structure as that of a second radiator 404.

That is, the antenna can realize three frequency bands, for which the third radiator 406 can be shared.

Figure 5:
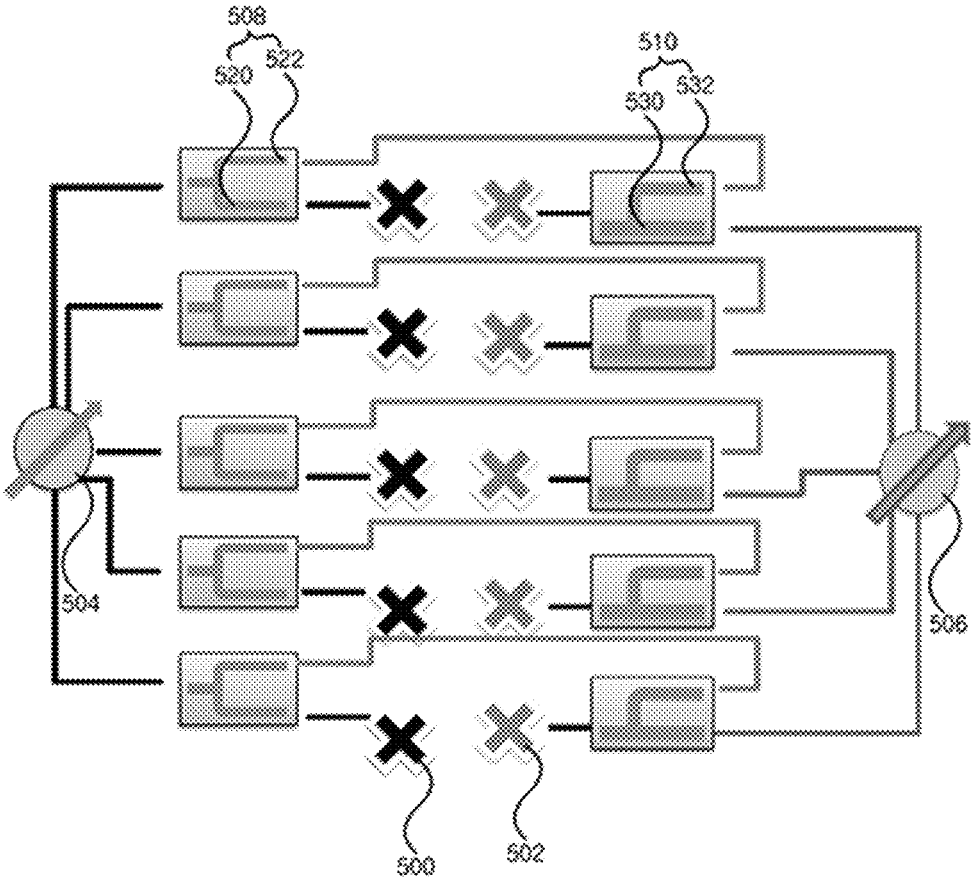
FIG. 5 schematically illustrates an antenna according to a fifth disclosed embodiment of the invention.

FIG. 5 schematically illustrates an antenna according to a fifth disclosed embodiment of the invention.

Referring to FIG. 5, an antenna based on this embodiment can include at least one first radiator 500, one or more second radiator 502, a first phase shifter 504, a second phase shifter 506, at least one 508, and one or more diplexer 510.

The first radiators 500 and the second radiators 502 may be arranged in parallel, i.e. facing each other. According to an embodiment of the invention, the first radiators 500 and the second radiators 502 can have the same structure.

Unlike the previously disclosed embodiments, the second radiators 502 can realize a second frequency band independently, but can also realize a first frequency band together with the first radiators 500. That is, all of the second radiators 502 can be shared for the first frequency band.

When the antenna outputs the radiation pattern for a first frequency band, the first phase shifter 504 may supply power to the respective first radiators 500 by way of the first conductive lines 520 of the dividers 508, and may supply power to the respective second radiators 502 by way of the second conductive lines 520 of the dividers 508 and the fourth conductive lines 532 of the diplexers 510.

When the antenna outputs the radiation pattern for a second frequency band, the second phase shifter 506 can supply power to the respective second radiators 502 by way of the third conductive lines 530 of the diplexers 510. Here, the first phase shifter 504 may not be operated.

As described with reference to the first to fifth disclosed embodiments, the antenna can include multiple radiators, where some of the radiators may be operated when realizing a first frequency band, and some of the radiators may be operated when realizing a first frequency band, with at least one of the radiators operated both when realizing the first frequency band and when realizing the second frequency band.

According to an embodiment of the invention, a radiator that is used both when realizing the first frequency band and when realizing the second frequency band can have a different structure from some of the radiators.

According to another embodiment of the invention, the power supplied to the radiator, which is used both when realizing the first frequency band and when realizing the second frequency band, can be different when realizing the first frequency band and when realizing the second frequency band. For example, a different phase shifter can supply power to the shared radiator for each frequency band.

According to still another embodiment of the invention, the radiators that are used both when realizing the first frequency band and when realizing the second frequency band can be arranged adjacent to one another.

According to yet another embodiment of the invention, the radiator used both when realizing the first frequency band and when realizing the second frequency band can be different according to the first frequency band and the second frequency band. For example, the radiator that is shared when the first frequency band is 1.8 GHz and the second frequency band is 2.6 GHz can be different from the radiator that is shared when the first frequency band is 1.2 GHz and the second frequency band is 2.2 GHz.

Figure 6A:
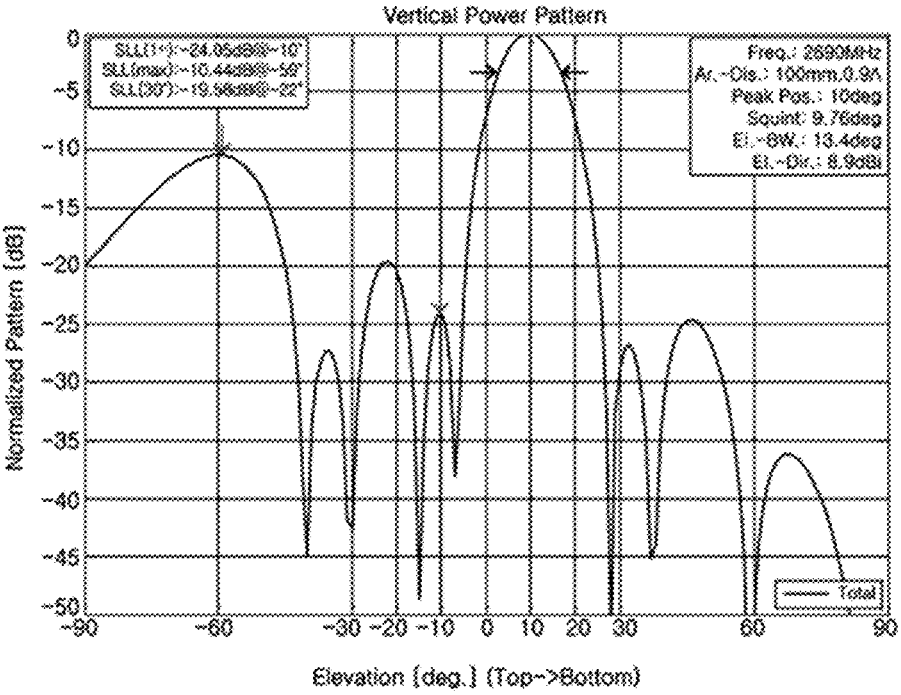
FIG. 6A and FIG. 6B illustrate the beam patterns of an antenna according to an embodiment of the invention.
Figure 6B:
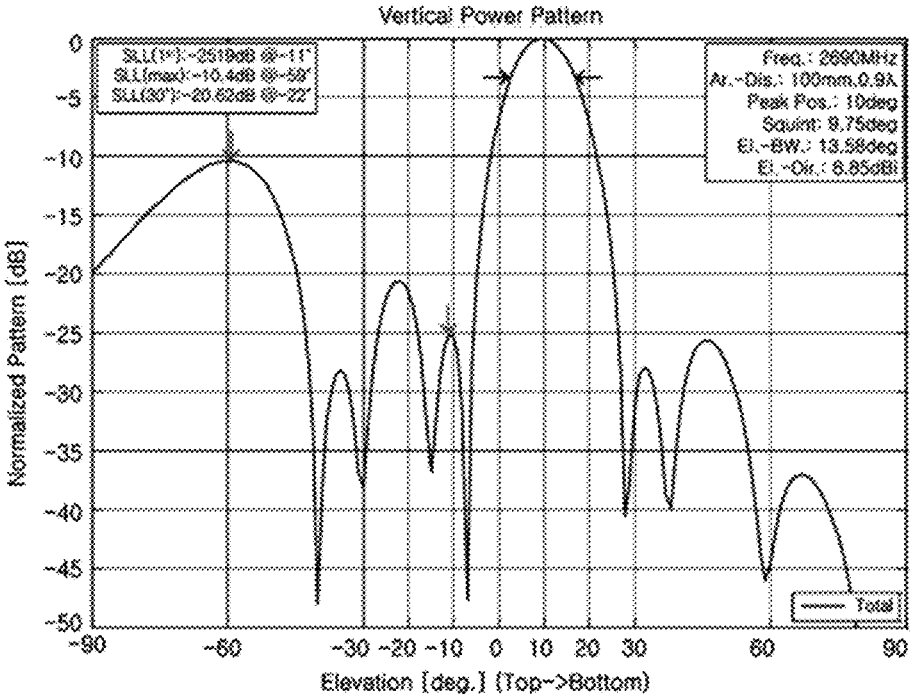

FIG. 6A and FIG. 6B illustrate the beam patterns of an antenna according to an embodiment of the invention.

FIG. 6A illustrates the beam pattern of an antenna in which the first radiators and the second radiators are arranged in series with no shared radiators, while FIG. 6B illustrates the beam pattern of an antenna according to the first disclosed embodiment in which a third radiator is shared.

Referring to FIGS. 6A and 6B, it can be seen that a conventional antenna and an antenna based on an embodiment of the invention output similar beam patterns. Thus, an antenna based on an embodiment of the invention can provide satisfactory communication services even with a reduced size and weight. Of course, the ratio of power supplied to the radiators may differ between an antenna based on an embodiment of the invention and a conventional antenna.

The embodiments of the invention described above are disclosed for illustrative purposes. Those of ordinary skill in the field of art to which the present invention pertains would understand that various modifications, alterations, and additions can be made without departing from the spirit and scope of the invention, and that such modifications, alterations, and additions are encompassed by the scope of claims below.

What is claimed is:

1. An antenna comprising:

at least one first radiator for a first frequency band;

one or more second radiator for a second frequency band; and a third radiator, wherein the third radiator is used when realizing the first frequency band and is also used when realizing the second frequency band; and wherein the third radiator is arranged between the at least one first radiator and the one or more second radiator, and wherein the at least one first radiator, the third radiator, and the one or more second radiator are arranged in series over a reflector plate.

2. The antenna of claim 1, further comprising:

a first phase shifter electrically connected with the at least one radiator;

a second phase shifter electrically connected with the one or more second radiator; and a diplexer, wherein the first phase shifter supplies power to the third radiator through a first conductive line of the diplexer when realizing the first frequency band, and the second phase shifter supplies power to the third radiator through a second conductive line of the diplexer when realizing the second frequency band.

3. The antenna of claim 1, wherein the third radiator has a same structure as that of a radiator for a low frequency band from among the frequency bands.

4. The antenna of claim 1, wherein the at least one first radiator and the one or more second radiator are arranged in parallel over a reflector plate such that the at least one first radiator and the one or more second radiator face each other.

5. The antenna of claim 4, wherein the third radiator is arranged in a staggered manner with respect to the at least one first radiator and the one or more second radiator.

6. The antenna of claim 1, further comprising:

fourth radiators for a third frequency band, wherein the at least one first radiator is arranged respectively within some of the fourth radiators, the one or more second radiator are arranged respectively within some of the fourth radiators, and the third radiator is arranged within another of the fourth radiators.

7. An antenna comprising:

at least one first radiator; and one or more second radiator, wherein the at least one first radiator and the one or more second radiator are used for a first frequency band, and only the one or more second radiator from among the radiators are used when realizing a second frequency band; and wherein the at least one first radiator and the one or more second radiator are arranged in parallel over a reflector plate such that the at least one first radiator and the one or more second radiator face each other.

8. The antenna of claim 7, further comprising:

a first phase shifter; and a second phase shifter, wherein the first phase shifter is electrically connected with the at least one first radiator and the one or more second radiator, and the second phase shifter is electrically connected with only the one or more second radiator.

9. The antenna of claim 8, further comprising dividers, wherein the first phase shifter dividers power by way of the dividers to the at least one first radiator and the one or more second radiator.

10. An antenna comprising radiators, wherein some of the radiators are operated when realizing a first frequency band, some of the radiators are operated when realizing a second frequency band, and at least one of the radiators are used both when realizing the first frequency band and when realizing the second frequency band; and wherein power supplied to the radiator used both when realizing the first frequency band and when realizing the second frequency band is different when realizing the first frequency band and when realizing the second frequency band.

11. The antenna of claim 10, wherein the radiator used both when realizing the first frequency band and when realizing the second frequency band has a different structure from that of some of the radiators.

12. The antenna of claim 10, wherein the radiators used both when realizing the first frequency band and when realizing the second frequency band are arranged adjacent to one another.

13. The antenna of claim 10, wherein the radiator used both when realizing the first frequency band and when realizing the second frequency band is different according to the first frequency band and the second frequency band.

* * * * *